United States Patent [19]

Brooks et al.

[11] Patent Number: 4,831,745

[45] Date of Patent: May 23, 1989

[54] REDUCING RESIDUAL MOISTURE ON CASTER ROLLS

[75] Inventors: William H. Brooks, Jackson; Weldon C. Ball, Huntingdon; John A. Clark, Cedar Grove, all of Tenn.

[73] Assignee: Norandal USA, Inc., Huntingdon, Tenn.

[21] Appl. No.: 125,385

[22] Filed: Nov. 25, 1987

[51] Int. Cl.[4] ..... F26B 3/32

[52] U.S. Cl. ..... 34/41; 34/110; 164/158

[58] Field of Search ..... 34/39, 40, 41, 110; 164/158, 149

[56] References Cited

U.S. PATENT DOCUMENTS 4,653,396 3/1987 Wennerberg ..... 34/41

*Primary Examiner*—Henry A. Bennet

*Attorney, Agent, or Firm*—Fleit, Jacobson, Cohn & Price

[57] ABSTRACT

A method of reducing residual moisture on caster rolls resulting from the application of a water based release agent or lubricant comprises placing a controllable heat source in close proximity to the top and bottom roll of the caster to evaporate the residual moisture from the roll surface.

4 Claims, 1 Drawing Sheet

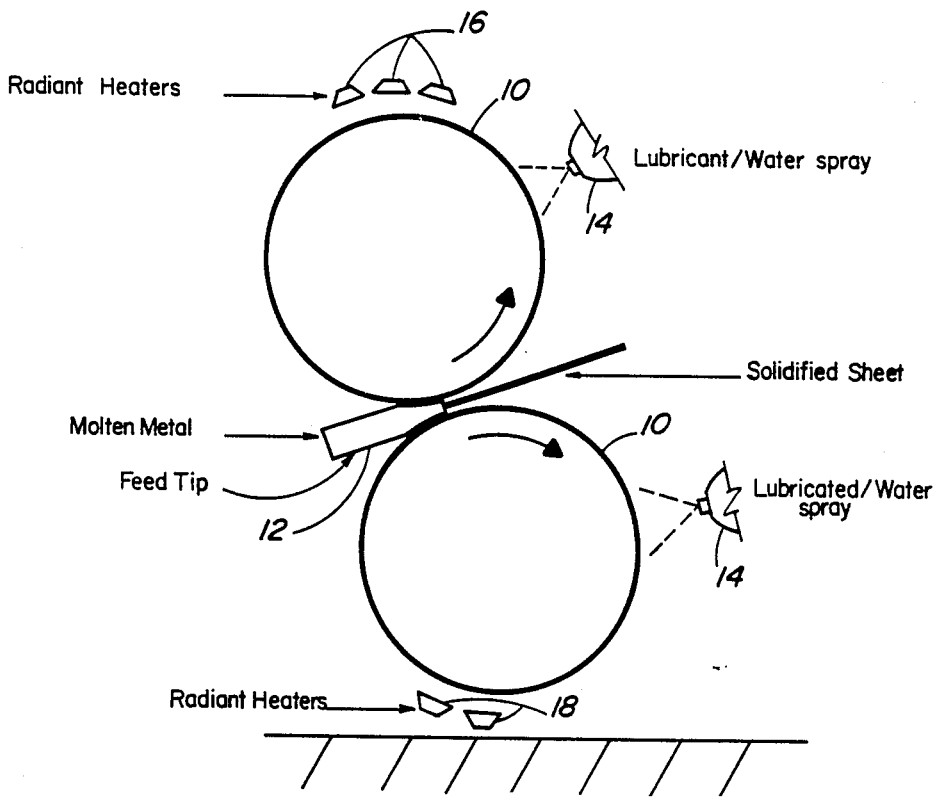
16
Radiant Heaters
10
Lubricant/Water spray
14
Solidified Sheet
Molten Metal
10
Feed Tip
12
Lubricated/Water spray
14
Radiant Heaters
18

REDUCING RESIDUAL MOISTURE ON CASTER ROLLS

This invention relates to a method of reducing residual moisture on caster rolls resulting from the application of a water based release agent or lubricant, and a roll caster using the method.

It is common practice in roll casting, more particularly aluminum roll casting, to apply a water based release agent or lubricant to the rolls to prevent sticking of the cast aluminum sheet to the rolls. The release agent or lubricant is normally applied in the form of a water spray and excess water removed from the caster rolls during contact of the caster rolls with the hot molten aluminum being cast. It was found, however, that the residual heat in the caster rolls after contact with the molten aluminum was only sufficient to remove a certain amount of water from the rolls, which limited the thickness of lubricant which could be applied to the rolls. When a thicker deposit of release agent or lubricant was applied, resulting in a higher amount of water to be removed from the rolls, the caster speed had to be reduced in order to be able to reduce the residual moisture on the caster rolls to a suitable level. This difficulty is aggravated by ambient humidity. The casting rate is consistently lower in summer than in the rest of the year.

Applicant has surprisingly found that residual moisture may be easily reduced by placing a controllable heat source in close proximity to the top and bottom rolls of the caster in order to evaporate the residual moisture from the roll surface.

It has been found that increasing the roll temperature by 20° to 50° F. was sufficient to allow a significant reduction in residual moisture, permitting an increase in lubricant thickness.

The invention will now be disclosed, by way of example, with reference to a preferred embodiment illustrated in the accompanying drawing.

Referring to the drawing, there is shown a diagram of molten metal being cast between two rolls 10 using a conventional feed tip 12. A colloidal lubricant/water spray 14 is applied to the rolls to increase mold release. In order to vaporize the water from the rolls three radiant heaters 16 of 7.2 KW each are placed in close proximity to the top roll of the caster and two 7.2 KW radiant heaters 18 close to the bottom roll. An electronic controller (not shown) is used to regulate the heat output between zero and one hundred percent. This has permitted to raise the roll surface temperature from normal 120° F. to about 150° F. Raising the roll surface temperature to 150° F. has permitted to increase the amount of lubricant by about 50% without encountering voids in the cast aluminum sheet resulting from moisture collecting in and around the feed tip. Such increase in the amount of lubricant has permitted to increase the casting speed by about 10% without "sticking" which is normally caused by a deficiency in lubricant.

Although the invention has been disclosed with reference to a preferred embodiment, it is to be understood that it is not limited to such embodiment and that other alternatives are also envisaged.

We claim:

1. A method of reducing residual moisture on surfaces of top and bottom caster rolls, said method comprising the steps of:

applying a water based release agent or lubricant to said surfaces of said top and bottom caster rolls, placing a controllable heat source in close proximity to said top and bottom caster rolls, and applying heat from said heat source to said top and bottom caster rolls for evaporating the residual moisture from the surfaces of said caster rolls.

2. A method as defined in claim 1, wherein radiant heaters are used as said heat source to raise the roll surface temperature by about 20° to 50° F.

3. In a roll caster apparatus comprising top and bottom caster rolls, the improvement comprising:

means for applying a water based release agent or lubricant to surfaces of said top and bottom caster rolls, and controllable heating means placed in close proximity to said top and bottom caster rolls to increase the temperature of said surfaces of said top and bottom caster rolls for evaporating residual moisture on the surfaces of said top and bottom caster rolls.

4. A roll caster apparatus as defined in claim 3, wherein radiant heaters are used as said controllable heating means.

* * * * *